US007114679B1

(12) United States Patent
Morgan

(10) Patent No.: US 7,114,679 B1
(45) Date of Patent: Oct. 3, 2006

(54) LOCKING MECHANISM FOR GEARED CORE WINDER

(76) Inventor: Wade Morgan, 1611 Fabricon Blvd., Jeffersonville, IN (US) 47130

( * ) Notice: Subject to any disclaimer, the term of this patent is extended or adjusted under 35 U.S.C. 154(b) by 0 days.

(21) Appl. No.: 10/677,411

(22) Filed: Oct. 2, 2003

(51) Int. Cl.
*B65H 75/24* (2006.01)

(52) U.S. Cl. ..... 242/575.2; 242/571.6; 242/394.1; 242/545.1

(58) Field of Classification Search ..... 242/394, 242/394.1, 545, 545.1, 575, 575.2, 571.6
See application file for complete search history.

(56) References Cited

U.S. PATENT DOCUMENTS

| | | | | |
|---|---|---|---|---|
| 1,037,988 | A | 9/1912 | Richards | |
| 1,244,865 | A | 10/1917 | Krohn | |
| 2,193,619 | A * | 3/1940 | Clements | 242/394.1 |
| 2,231,140 | A | 2/1941 | Richardson | |
| 2,765,991 | A * | 10/1956 | Frey et al. | 242/390.7 |
| 2,771,251 | A | 11/1956 | Silverstein | |
| 3,146,964 | A * | 9/1964 | Schultz et al. | 242/571.5 |
| 3,224,701 | A | 12/1965 | Wynne | |
| 3,602,346 | A * | 8/1971 | Daugherty | 192/48.8 |
| 3,913,854 | A | 10/1975 | McClure | |
| 4,058,268 | A | 11/1977 | Puccetti | |
| 4,158,446 | A | 6/1979 | Blake | |
| 4,160,530 | A | 7/1979 | Plach | |
| 4,284,251 | A | 8/1981 | Castillo | |
| 5,135,180 | A | 8/1992 | Morgan | |
| 5,490,640 | A | 2/1996 | Miller | |
| 5,683,057 | A | 11/1997 | Gangemi | |
| 6,007,268 | A | 12/1999 | Whittington | |

* cited by examiner

*Primary Examiner*—Kathy Matecki
*Assistant Examiner*—Sang Kim
(74) *Attorney, Agent, or Firm*—Scott R. Cox

(57) ABSTRACT

A geared core winder with locking mechanism for use with core rolls for fabric, material, rugs, paper or other such products comprised of a shaft containing a geared section, a first and second donut-shaped pieces placed on the shaft on opposite sides of the gears, a plurality of geared rods running between the donut-shaped pieces, wherein there is secured to each geared rod a plate which extends from the surface of the geared rods, wherein the geared rods interactingly engage the geared section of the shaft and a locking mechanism to prevent axial rotation of the geared core winder when engaged with core rolls. The locking mechanism is comprised of a donut-shaped locking piece which fits onto the shaft of the geared core winder and contains a central opening, a plurality of key locking pins fitting in key locking pins openings in the donut-shaped locking piece and into openings in the first donut-shaped piece of the geared core winder, and a rotation limitations system secured within the central opening of the donut-shaped locking piece, which rotation limitations system permits rotation of the geared core winder only in one direction.

7 Claims, 3 Drawing Sheets

LOCKING MECHANISM FOR GEARED CORE WINDER

BACKGROUND OF INVENTION

This invention is a locking mechanism used in combination with a geared core winder for securing core winders or chucks within a core roll which holds material, such as cloth, paper, rugs or other web-like products. More specifically, this device is a reversible locking mechanism used in combination with a geared core winder for restricting axial rotation in either direction of a geared core winder when placed within a core roll holding a cloth-like material. Devices for holding core rolls have been an important component of machines for winding or measuring cloth, paper, web-like products for many years. Generally these web-like products are wound onto hollow cores whose lengths frequently are in excess of 4 feet. Common cores are generally manufactured from a hollow thickened cardboard-like material with a thickness of ⅛ to about ¾ of an inch. The overall diameter of these cores may vary from an inch to several inches.

Conventional devices for holding these cores, sometimes called chucks or core winders, are frequently ribbed to provide a better grip on the cores. For example, one conventional core winder is a ribbed cone which is placed on a metal bar which runs within a core and is disclosed in U.S. Pat. No. 1,244,865. U.S. Pat. No. 2,771,251 discloses a conventional machine for measuring the length of cloth which contains a pair of devices for holding cores for rolls of cloth. Each of these devices for holding a core contains two chucks, 9, each of which is ribbed and one of each pair of which is adjustable in a horizontal plane to permit the device to hold various lengths of cores. A similar type of device for use with asphalt coatings is disclosed in U.S. Pat. No. 3,913,854. This device uses core engaging splines, 32, on the roll supporting units to hold the cores in place.

U.S. Pat. No. 1,037,988 discloses a core chuck with a key, 3, which extends from the surface of a conical piece and which fits within a notch in the core roll to restrict the movement of the core roll on the core chuck.

Another device designed for prevention of movement of a core roll is shown in U.S. Pat. No. 2,231,140 which discloses a core plug containing spiraling threads, 12, of a diameter greater than the shaft, 8, of the core plug. These spiral threads tend to grab onto the inside of the core and restrict its movement.

A more sophisticated device for holding core rolls of paper is disclosed in U.S. Pat. No. 4,284,251. This device discloses a bearing for supporting the core of rolls of paper with extension devices, 7, which extend from the surface of the supporting device to grab the inner surface of the core. These extension devices are extended out by a combination of a pair of telescopically coupled elements impacted by an expansion spring. See also U.S. Pat. No. 3,224,701 which discloses another device for holding a core roll.

A number of radial and/or axial releasable, locking core chucks or supports for core chucks have been disclosed, for example, in U.S. Pat. Nos. 6,007,268, 4,160,530, 4,158,446 and 4,058,268.

Another locking core chuck, which includes a threaded spindle with a drive for rotating the spindle, contains core chuck lugs which are free to rotate with the spindle until locked by an annular gear, is disclosed in U.S. Pat. No. 5,683,057.

A torque-actuated, expandable shaft assembly for core rolls containing a directional core engagement mechanism is disclosed in U.S. Pat. No. 5,490,640.

Although each of these patents discloses a core winding device for controlling the movement of a core roll which holds paper, fabric or web-like products, there is still a need for improvements to these core winders. Specifically, current core winders tend to tear up the core rolls because of their ribbed surface structure. In addition, slippage is still a significant problem especially with large rolls of material. Further, current core winders have difficulty in adjusting to different sized core rolls and may require a number of different core winder devices to fit various sizes of cores.

One device designed to address these issues is disclosed in U.S. Pat. No. 5,135,180. This geared core winder holds a core roll for fabric or other materials securely in position on the shaft of the core winder. In use fins, 38, extend out from the geared rods, 32, and lock into position within the core containing the fabric or other materials. These fins, 38, prevent the movement of the core roll in relation to the core lock, but only in one direction. For example, the core lock system may be used to wind material in a clockwise rotation, and will restrict rotation of the core in a counter clockwise direction. However, the mechanism is not effective in preventing additional clockwise rotation of the core.

Accordingly, it is an object of this invention to produce a locking mechanism for use with a core winder utilized in the winding of fabric, rugs, paper, materials and other web-like products on cores.

Another object of the in invention is a reversible locking mechanism for use with core winders, particularly geared core winders, which can restrict clockwise or counterclockwise rotation of the geared core winder while said core winder is present within a core.

These and other objects of the invention will be apparent from a review of the description and the appended claims.

SUMMARY OF INVENTION

In accordance with the present invention there is provided a locking mechanism useful to restrict axial rotation of a geared core winder comprised of a donut-shaped locking piece containing a central opening, a plurality of key lock pin openings extending axially through the donut-shaped locking piece parallel to the central opening, and a rotation limitation system contained within the central opening in the donut-shaped locking piece. This rotation limitation system permits rotation of the central shaft of the geared core winder in one axial direction only, either clockwise or counterclockwise. Rotation of the donut-shaped locking piece in relation to the geared core winder is restricted by the introduction of the locking pins, which extend from the locking pin openings in the donut-shaped locking piece, into corresponding locking pin openings, which have been cut into the donut-shaped sections of the core winder.

The invention is also a combination of the locking mechanism useful to prevent axial rotation of a geared core winder described above utilized in combination with a geared core winder.

DETAILED DESCRIPTION OF THE DRAWINGS

This invention will now be described with reference to the accompanying drawings in which.

DETAILED DESCRIPTION OF THE PREFERRED EMBODIMENT

Figure 1:
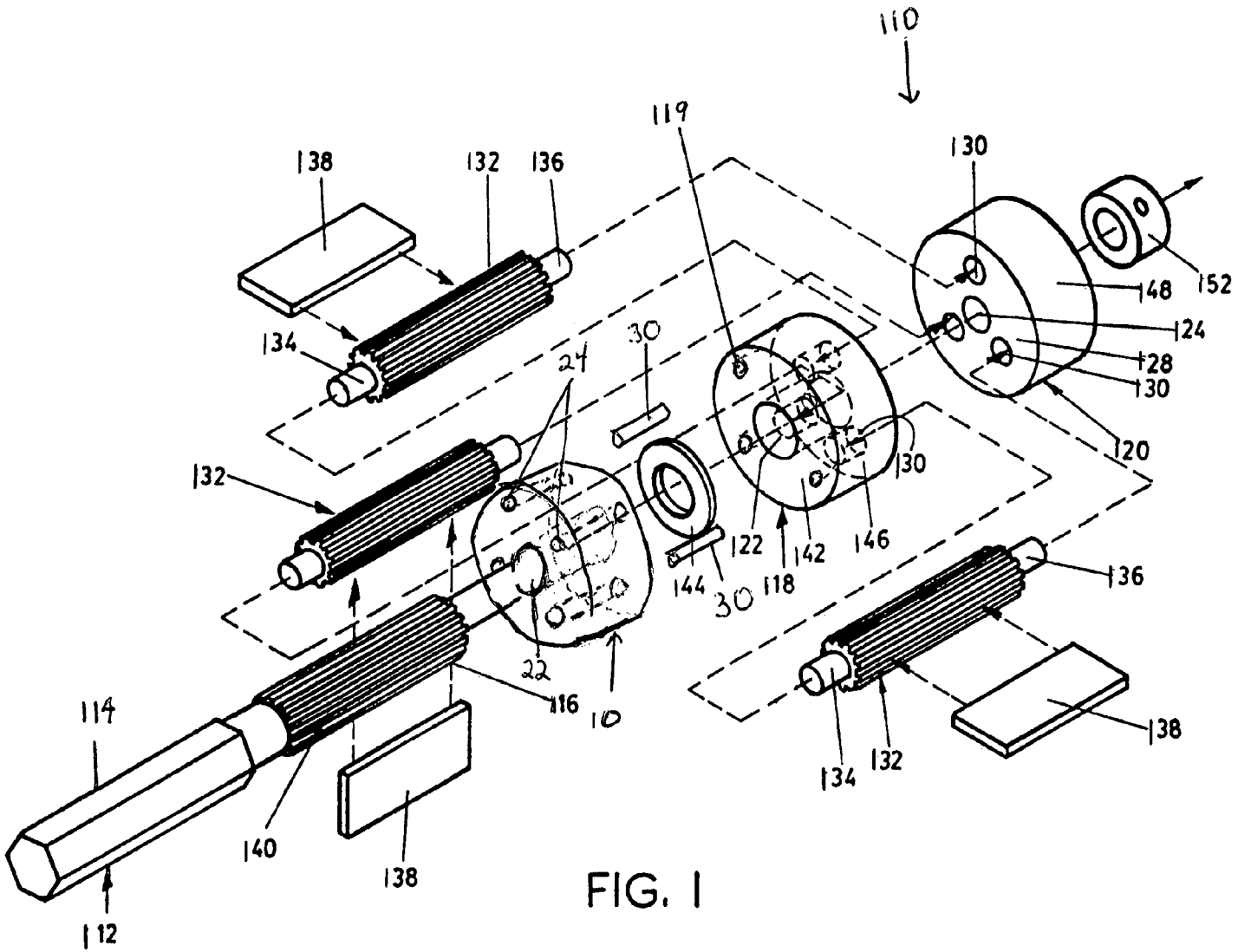
FIG. 1 is an exploded, perspective view of the locking mechanism of the invention utilized in combination with a geared core winder.

Although the invention is adaptable to a wide variety of uses, it is shown in the drawings for purposes of illustration as embodied in a locking mechanism, (10), useful to prevent axial rotation of a geared core winder (110). The locking mechanism (10) can be utilized with any type of core winder or geared core winder (110) which contains, or is adapted to contain, a first donut-shaped piece (118) with openings (119), such as is shown in FIG. 1. However, the locking mechanism (10) is not limited to use with the specific geared core winder (110) disclosed hereinafter. Rather any core winder which can be used with a core roll which holds, or is adapted to hold material is within the scope of this invention.

In one preferred embodiment the geared core winder (110) used with the locking mechanism (10) of this invention is comprised of a shaft (112) containing a first section (114) and a partially geared second section, (116), first (118) and second (120) donut-shaped pieces, each with a central opening (122, 124) through which a portion or all of the second section (116) of the shaft (112) passes, wherein the surfaces (126, 128) of the first and second donut-shaped pieces (118, 120), which face each other (the inner surfaces) each contain a plurality of openings (130); a plurality of geared rods, (132), wherein each end of each geared rod (134, 136) extends into one of the openings (130) in the inner surfaces of the donut-shaped pieces (118, 120); a plurality of plates, (138), wherein each is secured to one of the geared rods (132); and a device for holding the donut-shaped pieces (118, 120) onto the shaft (112). See FIG. 1.

The shaft (112) of the geared core winder (110) is divided into the first section (114) and the partially geared second section (116). The first section (114) extends into the machinery used to wind the fabric or other such material, to measure the fabric, and for many other common activities wherein a significant amount of material is contained upon a fabric roll. (Devices for measuring fabric may be provided, for example, by Measuregraph of St. Louis, Mo.) In a preferred embodiment the first section (114) of the shaft has a hexagonal cross section, is about ½ to about 2 inches in thickness and is preferably about 2 to about 8 inches in length. The thickness of the cross sectional portion is not particularly critical and will depend on the type of machinery into which it is inserted. The shape of this section is also not critical as it is formed in a shape for use with conventional measuring equipment.

There is secured to the first section of the shaft the partially geared second section (116). This partially geared second section (116) can be a separate portion of the shaft, (112) which is secured to the first section (114) or, in a preferred embodiment, it is an extension of the first section (114), wherein the entire shaft is formed from a single piece of metal. At least a portion (140) of this second section is circular in cross section containing gears, wherein the number, size and thickness of the gears is dependent upon the desire of the manufacturer. These gears are conventional gears used in machinery and are not unique in size, shape or construction to this device. In one embodiment there are approximately 10–20 gears around the diameter of the partially geared second section (116) of the shaft, each gear being approximately 1/32 to about ¼ of an inch in height. The diameter of the partially geared second section (116) is also not critical but is preferably from about ½ to about 1½ *inch*.

Placed over the shaft (112) at the end of the first section is the first donut-shaped piece, (118). This first donut-shaped piece (118) is generally circular in cross section with an overall diameter less than the diameter of the opening in the roll cores into which the geared core winder is inserted. For example, when the opening in the roll core is approximately 2 to 2½ *inches*, the *donut-shaped* piece (118) should be at least about ¼ of an inch less in diameter and preferably ½ of an inch less in diameter than the diameter of the opening in the roll cores. The first donut-shaped piece (118) rotates freely around at least a portion of the circumference of the partially geared second section.

The first donut-shaped piece (118) has an inner (126) and outer (142) flattened surface. The first donut-shaped piece is approximately ½ to about 2 inches in thickness, although its thickness is not critical.

In a preferred embodiment a washer, (144) preferably a plastic washer, is placed between the inner end of the first section of the shaft and the outer surface (142) of the first donut-shaped piece (118) to permit free rotation of the first donut-shaped piece on the shaft (112).

The inner surface (126) of the first donut-shaped piece (118) contains a number of openings (130) extending approximately half the thickness of the donut-shaped piece. (118, 120). The depth of each of these openings is not critical. However, the location of those openings (130) is coordinated with the openings (119) in the outside surface (142) of the first donut-shaped piece (118). The outer surface (142) of the first donut-shaped piece (118) contains a plurality of these openings (119). These openings (119) are designed to receive the key locking pins (30), which are discussed in more detail later. The depth and the size of these openings (119) should be sufficient to receive the key locking pins (30) of the locking mechanism (10).

The second donut-shaped piece (120) is approximately the mirror image of the first donut-shaped piece (118). However its outside surface need not contain openings similar to those in the outside surface (142) of the first donut-shaped piece (118). It is separated from the first donut-shaped piece by that portion (140) of the partially geared second section (116) which is geared. The center opening (124) in the second donut-shaped piece (120) is preferably smaller in diameter than the diameter of the geared portion (140) of the partially geared second section. This smaller diameter restricts the second donut-shaped piece (120) from extending over the geared portion (140) of the partially geared second section (116). The second donut-shaped piece (120) also contains openings (130) in its inner surface which face the openings (130) in the inner surface (126) of the first donut-shaped piece (118) and are approximately the same size and depth as those openings. These openings are for receipt of the ends (134,136) of the geared rods (132). The number of these openings (130) is dependent upon the desire of the manufacturer, but in a preferred embodiment a minimum of three such openings is provided in each donut-shaped piece (118, 120).

Running between each pair of these openings (130) in the first and second donut-shaped pieces are the geared rods (132). The geared rods (132) are comprised of three elements, the first (134) and second ends (136) which project into the openings (130) in each of the flattened surfaces of the first and second donut-shaped pieces (118, 120) and the geared portion of the geared rods (132). The overall length of each of these geared rods (132) is not critical but should be at least about 1½ inches *and*, *preferably*, 1½ to 4 inches. Each of these geared rods (132) contains gears of approximately the same size as the gears contained in the geared portion (140) of the partially geared second section (112). In addition, each of these geared rods (132) run parallel to the geared portion (140) of the partially geared second section (112) and each interactingly engages the geared portion of the partially geared second section. Each end (134, 136) of these geared rods (132) fits within the openings (130) contained in the inner flattened surfaces (126, 128) of the first (118) and second (120) donut-shaped pieces with each of these openings (130) being of sufficient size to permit the free and smooth rotation of the geared rods within these openings. The result of the interacting engagement of the geared portion (140) of the partially geared section with each geared rod (132) is that upon rotation of the geared portion (140) of the partially geared second section, each of the geared rods (132) will also rotate.

Secured to each geared rod is a plate (138). Each plate (138) is generally rectangular in shape but is not as long as is the geared portion of each of the geared rods (132). Its width may vary, although preferably, it is about ½ to about 2 inches in width. The thickness of these plates (132) can also vary from about ⅛ inch to about ½ inch. The width of these plates will depend on the overall size of the geared core winder (110) and the distance of the geared rods (132) from the outer surfaces (146, 148) of each of the donut-shaped pieces (118,120). The width of the plates (138) should be sufficient so that when the geared core winder (110) is properly rotated, they hit the surface of the adjacent geared rod and project over the outside surfaces of the donut-shaped pieces.

The arrangement of each of these plates (138) on the geared rods (132) is important. The plates (138) are secured to the geared rods (132) such that each extends approximately perpendicular from a tangent to the surface of the geared rods (132) with the point of contact of the tangent with the geared rod (132) being where the plate (138) meets the geared rod (138). In addition, the plates (138) run parallel to the gears of the geared rod. The angle of attachment of the plates to the geared rods can vary up to about 30° off the perpendicular without significantly reducing the effectiveness of the geared core winder (110). Further variations off the perpendicular are possible, but such variations may reduce the effectiveness of the geared core winder. In addition, each of the plates (138) should extend away from the geared rod (132) at an approximately perpendicular direction at the same time. Thus, when one plate (138) is perpendicular to the tangent of its geared rod, all of the plates (138) should be approximately perpendicular to their respective tangent. Although such perpendicularity is important for all of the plates, it is not critical and minor variations are acceptable. The plates (132) can be secured to the geared rods by any conventional method, such as by welding.

The outer end (150) of the partially geared second section (116) may extend out from the outer surface of the second donut-shaped piece (120) a sufficient distance to permit the use of a mechanism for securing the second donut-shaped piece (120) onto the shaft (112). This mechanism for securing the second donut-shaped piece onto the shaft can be any conventional mechanism, such as a bolt, a nut, or a ring (152) with securing screw which secures against the surface of the shaft.

During operation of the geared core winder, (110) the first (118) and second (120) donut-shaped pieces can rotate fully clockwise or counterclockwise about the shaft (112) until the plates (138) projecting outward from the core winder (110) contact the inside surface of a roll core. Once the plates (138) are securely set against the inside surface of the roll core, further rotation of the geared portions (132) of the geared core winder (110) in the same direction is restricted by the core roll and its contents. By this mechanism, the first (118) and second (120) donut-shaped pieces are also restricted in rotation in this same direction. However, rotation in the opposite direction is not restricted as rotation in this direction disconnects the plates (138) from the inside surface of the core roll by rotating them back to the surface of the geared rods (132). There is often a need to retain contact of the plates (138) with the inside surface of the core roll while at the same time preventing rotation of the core winder (110) in the opposite direction. The locking mechanism (110) of the invention is designed to accomplish this task.

Figure 2:
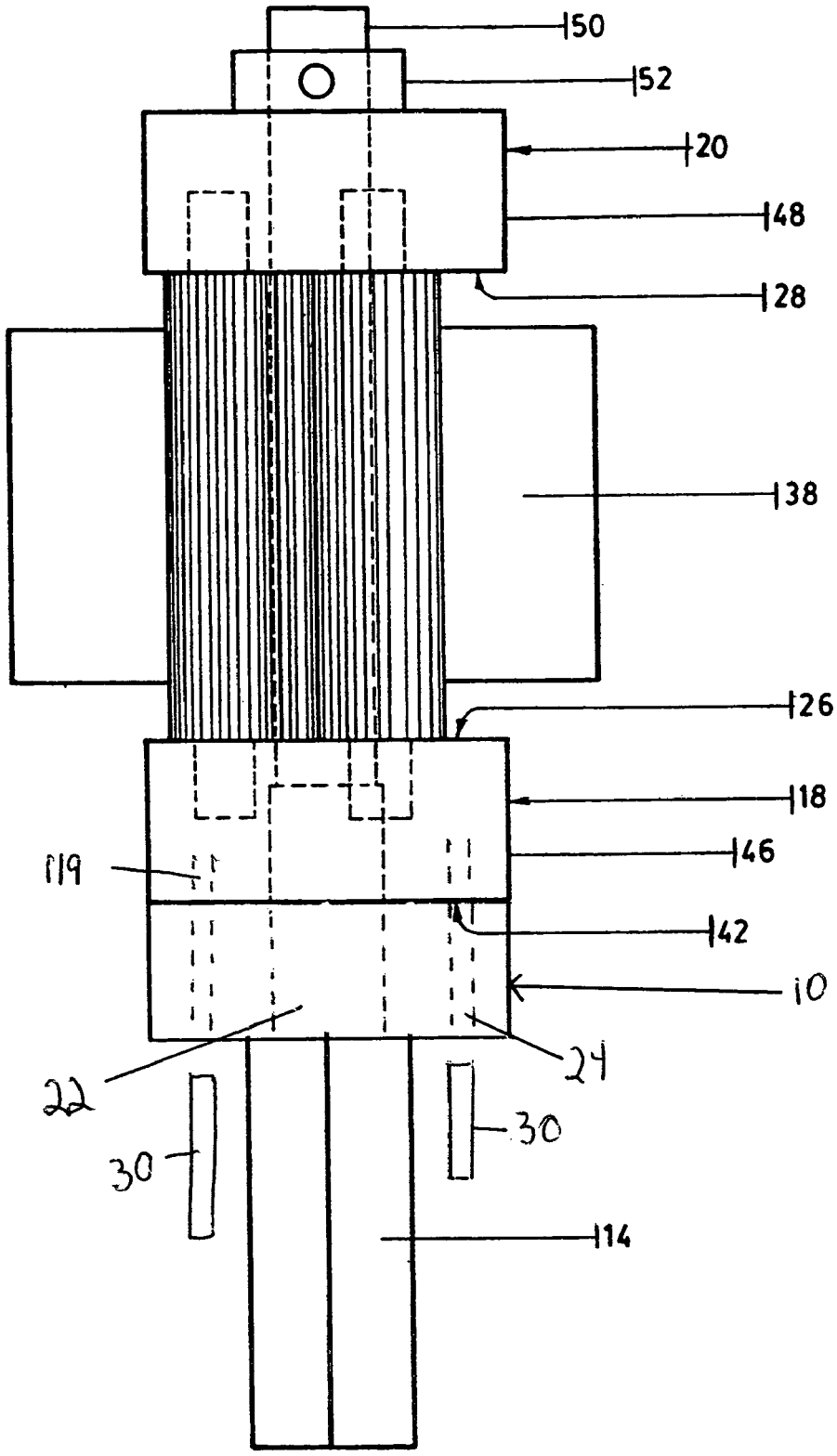
FIG. 2 is a side view of the locking mechanism of FIG. 1 in place on a geared core winder.
Figure 3:
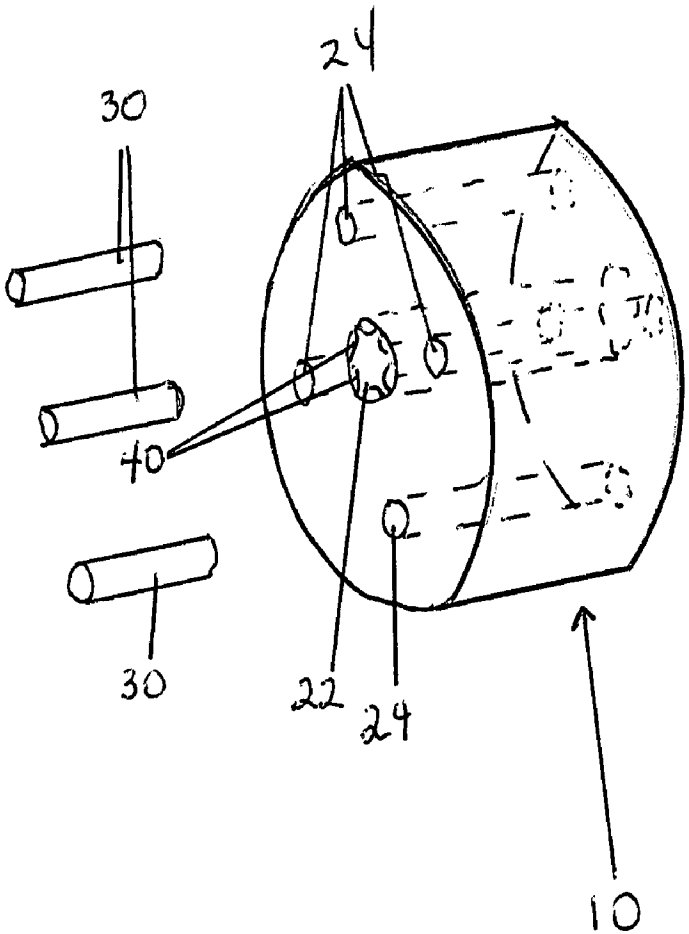
FIG. 3 is an perspective view of the locking mechanism of FIG. 1.

As shown in FIGS. 2 and 3 the locking mechanism (10) is comprised of a donut-shaped locking piece (20) which fits over the shaft (112) of the geared core winder (110). The inside cross section of the central opening (22) in the donut-shaped locking piece (20) is designed in approximately the same cross-sectional shape as that of the shaft (112). Thus, in one preferred embodiment, when the cross section of the shaft (112) is circular, the cross-section of the central opening (22) is generally circular. Contained within the inside portion of the locking mechanism central opening (22) is the rotation limitation system (40). Various rotation limitation systems (40) are within the scope of the invention. For example, the rotation limitation system (40) may be comprised of a rachet system, a sprag system or a overriding clutch system. In a preferred embodiment this rotation limitation system (40) is comprised of a overriding clutch system. This system (40), when contained within the circular opening (22) of the donut-shaped locking mechanism (10) surrounds the circular shaft (112) and freely permits rotation of the shaft (112) in one direction only, such as a clockwise direction, while preventing rotation of the shaft (112) in the opposite direction, such as a counterclockwise direction. Devices which perform this function are well known in the industry.

The rotation of the donut-shaped locking mechanism (20) in relation to the donut-shaped piece (118) of the geared core winder (110) can be further restricted by use of any conventional device. In one preferred embodiment a plurality of openings (24) are cut into the donut-shaped locking piece (20) which line up with corresponding openings (119) cut in the outside surface (142) of the donut-shaped piece (118) of the geared core winder (110). To restrict axial rotation of the donut-shaped locking mechanism (20) in relation to the donut-shaped piece (118), key locking pins (30) are placed, and may be secured, within the plurality of openings (24) in the donut-shaped locking piece (20) and project into the openings (119) in the outside surface (142) of the donut-shaped piece (118). Alternatively, and preferably, the key locking pins (30) are secured only into the openings (119) in the outside surface (142) of the donut-shaped piece (118). (Other locking systems, such as built-in holding studs, may be used as an alternative to the key locking pins (30).) Once these key locking pins (30) are in position within both the key locking pin openings (211) and the openings (119) of the donut-shaped piece (118), rotation of the donut-shaped locking piece (20) in relation to the donut-shaped piece (118) of the geared core winder is prevented. In this structure the donut-shaped locking piece (20) and the first donut-shaped piece (118) of the geared core winder can only rotate in combination around the shaft (112). While the combination of the donut-shaped locking piece (20) and the first donut-shaped piece (118) may freely rotate around the shaft (112) in one axial direction, because of the rotation limitation systems (40) of the locking mechanism (10), free rotation of the locking mechanism system (10) in the opposite axial direction is prevented. Because the donut-shaped locking piece (20) is restricted in rotation except in combination with the first donut-shaped piece (118) of the geared core winder (110), rotation of the geared core winder is restricted by this locking mechanism (10).

To permit the disengagement of the geared core winder (110) from the core, the locking mechanism is pulled outward on the shaft (112), disengaging the plurality of key locking pins (30) from the openings (24) in the locking mechanism (10) and/or from the openings (119) in the first donut-shaped piece (118).

An advantage of this locking mechanism (10) of the invention is that rotation can be prevented in either a clockwise or counterclockwise direction, merely by reversing the orientation of the donut-shaped locking piece (20). To reverse the orientation, the donut-shaped locking piece (20) is removed from the shaft (112), rotated 180° so that the inner face of the donut-shaped locking piece (20) now becomes the outer face of the donut-shaped locking piece (20) and then the donut-shaped locking piece (20) is again placed onto the shaft (112). This rotation also reverses the orientation of the rotation limitation system (40). In this orientation, rotation of the geared core winder (110) is restricted in the opposite direction from the previous position.

The entire device, other than the plastic washer, is preferably made of high strength metal, preferably tempered steel.

In operation, the first section (114) of the shaft (112) is placed within a complementary holding portion of a machine for measuring the length of cloth or for rolling or unrolling rolls of fabric, etc. Because of its hexagonal shape, the geared core winder (110) is held securely within the cloth measuring machine. The first (118) and second (120) donut-shaped pieces are then rotated fully in one direction as permitted by the locking mechanism (10). This rotation moves the plates (138) on the geared rods (132) until they project a minimum distance outward from the geared core winder (110) and preferably rest against the adjacent geared rod. A roll, such as a fabric roll or cloth roll, is then placed over the first (118) and second (120) donut-shaped pieces. The first section (114) of the shaft (112) is then rotated. As it rotates, it also rotates the partially geared second section (116) of the shaft (112). This partially geared second section (116) then rotates the geared rods (132). The geared rods (132) then rotate the plates (138) outward until they contact the inside surface of the core roll. These plates (138) then bite into the inner surface of the roll core and control the movement of the roll core. This controls not only the forward speed of rotation of the core roll but also prevents the roll core from backing up unexpectedly because of the interaction of the plates (138) with the inside of the roll core. The plates (138) when contacting the core roll also tend to center the roll core causing less vibration as the roll is turned.

To restrict further rotation of the geared core winder (110) once the plates (138) are firmly secured against the inner surface of the roll core, the donut-shaped locking piece (20) is placed over the shaft (112) and locked in place against the first donut-shaped piece (118). Other shapes for the locking piece may also be used. To lock it into position, the key locking pins (30), which are secured within a plurality of openings (24) in the donut-shaped locking piece (20), are inserted into openings (119) in the outer surfaces of the donut-shaped piece (118). The key locking pins (30) may also be first positioned within the openings (119) in the outside surface (142) of the first donut-shaped piece (118) and then the plurality of openings (24) in the donut-shaped locking piece (20) are rotated until the key locking pins (30) fit with the plurality of openings (24). Once the locking mechanism (10) is in position, rotation of the core roll is permitted only in one direction. Rotation in the other direction is restricted because of the interaction between the plates (138) and the inner surface of the core roll. Rotation in the opposite axial direction is prevented by the rotation limitations systems (40) contained in the locking mechanism. The direction of permitted rotation can be reversed merely by removing the donut-shaped locking piece (20) from the shaft (112), rotating it 180° and again placing it on the shaft (112).

It will be apparent from the foregoing that while particular forms of the inventions have been illustrated and described, various modifications can be made without departing from the scope of the invention. Accordingly it is not intended that this invention be limited by the description contained in the specification.

The invention claimed is:

1. A geared core winder locking system comprised of a geared core winder, comprising a shaft containing a gear portion, a first donut-shaped piece with a central opening and locking pin openings, wherein said first donut-shaped piece fits over the shaft such that said first donut-shaped piece is located on one side of the geared portion, a second donut-shaped piece with a central opening, wherein said second donut-shaped piece fits over the shaft located on the opposite side of the geared portion of the shaft from the fist donut-shaped piece, a plurality of geared rods secured between the first and second donut-shaped pieces, wherein each geared rod interactingly engages the geared portion of the shaft and a plurality of plates each of which is secured to one of the geared rods, and a locking mechanism comprising a donut-shaped locking piece placed on the shaft of the geared core winder, wherein the donut-shaped locking piece contains a central opening, a plurality of key locking pin openings, a rotation limitations system contained within its central opening, and a plurality of key locking pins contained within the plurality of openings in the donut-shaped locking piece.

2. The geared core winder locking system of claim 1, wherein the first donut-shaped piece of the geared core winder further comprises openings in its outside surface which can be utilized with the key locking pins to hold the geared core winder in position.

3. The geared core winder locking system of claim 1 wherein the rotation limitation system, upon being reversed in position on the shaft of the core winder, reverses the restriction on rotation of the core winder.

4. The geared core winder locking system of claim 3 wherein the key locking pin openings extend entirely through the donut-shaped locking piece.

5. The geared core winder locking system of claim 1 wherein the key locking pin is secured within the key locking pin opening.

6. The geared core winder locking system of claim 1 wherein the key locking pin is secured within the locking pin opening of the first donut-shaped piece of the geared core winder.

7. The geared core winder locking system of claim 1 wherein the key locking pin is secured within openings in the core winder.

* * * * *